US006390469B1

(12) United States Patent
Jones et al.

(10) Patent No.: US 6,390,469 B1
(45) Date of Patent: May 21, 2002

(54) SHEET MATERIAL CONVEYING APPARATUS WITH HEIGHT-ADJUSTABLE POCKETS

(75) Inventors: Jackson Hacker Jones; Andrew Lynn Klopfenstein, both of Rochester; Hugh Thompson Lee, Derry, all of NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/702,012

(22) Filed: Oct. 30, 2000

(51) Int. Cl.[7] ..... B65H 39/10

(52) U.S. Cl. ..... 271/294; 271/223; 270/52.2; 270/58.19; 270/58.25

(58) Field of Search ..... 271/292, 294, 271/295, 223, 903; 270/52.2, 52.19, 58.19, 58.25

(56) References Cited

U.S. PATENT DOCUMENTS 3,891,202 A * 6/1975 Kircher ..... 270/58.25
4,124,203 A 11/1978 Mueller ..... 270/55
4,133,521 A * 1/1979 Muller ..... 270/52.2
4,496,141 A 1/1985 Nayate ..... 270/55
5,213,318 A * 5/1993 Newhall ..... 270/52.2
5,251,888 A 10/1993 Eugster ..... 270/55
5,911,416 A 6/1999 Klopfenstein ..... 271/223

* cited by examiner

*Primary Examiner*—H. Grant Skaggs
(74) *Attorney, Agent, or Firm*—Davidson, Davidson & Kappel, LLC

(57) ABSTRACT

A sheet material conveying apparatus includes a plurality of pockets, each pocket including a setting device for adjusting a height of the pocket when the pocket is stationary so as to define a set height, the setting device including a setting rod, a ring gear having an outer surface connected to the setting rod, and a lock ring selectively releasable from the ring gear, the setting rod including a disengaging device for releasing the lock ring from the ring gear during a setting operation. A method and a sheet material pocket are also provided.

23 Claims, 18 Drawing Sheets

SHEET MATERIAL CONVEYING APPARATUS WITH HEIGHT-ADJUSTABLE POCKETS

BACKGROUND OF THE INVENTION

1. Field of the Invention

The present invention relates generally to a sheet conveying apparatus, for example, for conveying newspapers, and more particularly to a sheet conveying apparatus having pockets moving on a track. The present invention also relates to such pockets and to a method for conveying such pockets.

2. Background Information

U.S. Pat. No. 5,911,416 describes a sheet material conveying apparatus with a plurality of pockets moveable around a track to accept sheet material from sheet material feeders. These pockets permit for example a first outer section of a newspaper to first be fed into the pockets by a first sheet material feeder, and then an inner newspaper section to be inserted between the folds of the first outer newspaper section.

The apparatus of the '416 patent uses a lift cam 20 to move a semicircular actuator gear 150 to rotate a drive shaft 110 so as to set a height for pocket feet 90 arranged on racks 80. A pawl and rachet mechanism prevents the pocket from opening. The sheet material can then be accepted and inserted into the pockets.

To deliver the sheet material, the pawl and ratchet mechanism can then be released by a trip cam 22. Tracks 80 move to a lower position through a biasing spring, so that feet 90 release through operation of a driver cam 130. The sheet material in the pocket can thus move out of the pocket from the bottom to be further conveyed or to be stacked.

U.S. Pat. No. 5,251,888 purports to describe pockets moveable along an endless path. Each pocket is provided with two vertically adjustable stops mounted displaceably in a pocket carrier. A guide member purportedly can be set to vertically adjust the stops as the pockets are moved along the endless path.

These patents do not provide setting devices directly on the pockets for setting when the pockets are stationary.

BRIEF SUMMARY OF THE INVENTION

Commonly-assigned U.S. patent application Ser. No. 09/662,277, entitled "SHEET MATERIAL CONVEYING APPARATUS WITH INDIVIDUALLY-ADJUSTABLE POCKETS" filed on Sep. 14, 2000, describes a plurality of manually-adjustable pockets, each having a setting device for adjusting a height of the pocket. The commonly-assigned application is hereby incorporated-by-reference herein. The setting device of the commonly assigned application is manually-operated by an operator, who turns a knob gear and sets a lock ring for a desired pocket height. It may be desirable to provide a less time-consuming, one-step setting device for each pocket.

The present invention provides a sheet material conveying apparatus comprising a plurality of pockets, each pocket including a setting device for adjusting a height of the pocket so as to define a set height, the setting device including a setting rod, a ring gear having an outer surface connected to the setting rod, and a lock ring selectively releasable from the ring gear, the setting rod including a disengaging device for releasing the lock ring from the ring gear during a setting operation.

The present invention permits the pockets to be set with a single motion, for example a sliding motion of the setting rod, to the set height and to operate continuously at the set height. The operator need not adjust the lock ring.

A reset station is provided to include a movable reset incline ramp which is then also set for the new height, and may also include a lock engagement device.

Each pocket may include a slide gear rotationally fixed with the ring gear, and selectively releasable from the lock ring, thus providing that the ring gear is selectively releasable from the lock ring.

The lock ring preferably is a single point ratchet and the pocket preferably further includes a pawl for interacting with the lock ring at all times, except during a pocket bottom release operation.

The setting rod preferably includes at least two preset height notches for permitting an operator to set the pocket height to two different settings, for example for 10½ inch sheets and 12 inch sheets. More height setting on the rod however can be provided. The notches can interact with, for example, a ball detent in a rod support, the rod support being connected to the pocket wall. A second rod support is also preferably provided.

The disengaging device of the setting rod preferably includes at least one raised cam section, which can move the slide gear outwardly with respect to the lock ring. The lock ring thus disengages from the slide gear so as to be rotatable with respect to the ring gear and slide gear, from the slide gear. The lock gear then remains locked by the pawl, while the setting rod moves the pockets, via rotation of the ring gear, to a different height. Once the different height is achieved, the cam section no longer acts on the slide gear, which through a spring action re-engages the lock gear to lock the height of the pocket in place.

The setting rod may include a fine adjustment mechanism, for example through a screw interaction of two parts of the rod.

In a second embodiment of the present invention permitting for a continuous setting of different heights, the setting rod may include curved teeth and be rotatable, and the disengaging device includes an axially extending cam blade located between the star gear and the lock ring. The cam blade moves the slide gear to disengage the lock ring through a twist of the setting rod. An operator wanting to change a pocket height thus twists the setting rod to disengage the slide gear, and then moves the rod axially to change the height of the pocket.

The ring gear preferably has a first outer gear section geared to a spring loaded semi-circular gear and a second outer gear section geared to the setting rod. The ring gear is rotationally fixed to the slide gear through interior star gearing, the slide gear being rotationally fixed to the shaft which can set the height of the pockets. The lock ring also fits around the shaft, and the slide gear is selectively engageable with the lock ring, by sliding of the slide gear axially with respect to the shaft. When the lock ring engages the slide gear, both elements rotate together. When the slide gear is disengaged from the lock ring by sliding of the slide gear using a cam or cam blade, the lock ring is free to rotate about the shaft, while the slide gear remains rotationally fixed with respect to the shaft and the ring gear.

The semicircular gear preferably is spring-loaded in a direction which causes the fingers to drop to a bottom of the pocket and release. The unlocking of the pawl and thus the lock ring at the release station thus causes the fingers to release and to release any sheet material in the pocket.

The present invention also provides a sheet material pocket comprising a first wall, a second wall spaced apart from the first wall so as to define a sheet material opening, at least one finger movable with respect to the first wall for defining a pocket bottom, the at least one finger releasable so that the pocket bottom opens, a shaft connected to the at least one finger for moving the at least one finger, a slide gear rotationally fixed with respect to the shaft and slidable with respect to the shaft, a ring gear rotationally fixed with respect to the slide gear, and a lock ring selectively engageable with the slide gear.

Preferably, a slidable setting rod is geared to the ring gear and has a disengaging mechanism. In a first embodiment, the disengaging device includes a raised cam for moving the slide gear, while in a second embodiment, the disengaging device includes a cam blade actuated by a rotation of the setting rod.

The setting rod preferably is slidable in a first and second support fixedly connected to the first wall. One of the first and second supports can include a ball detent for interacting with setting notches in the setting rod, the notches corresponding to various pocket heights. Preferably at least two setting notches are provided.

The present invention also provides a method for setting a height of a sheet material pocket comprising the steps of:

sliding a rod while the pocket is stationary to move fingers of the pocket so as to set the pocket to a set height;

moving a gear axially with the rod, the gear thus disengaging a lock mechanism, the lock mechanism remaining fixed during setting; and re-engaging the gear with the lock mechanism.

The rod preferably is moved between at least two predetermined positions, preferably by the engagement of a notch on the rod with a ball detent in a rod support.

The moving step preferably includes using a raised cam to slide the gear axially. The gear preferably is a slide gear interacting with a ring gear, the ring gear being geared to the rod.

The moving step alternatively may include rotating the rod, so that a cam blade moves the gear away from a lock ring of the lock mechanism.

"Rod" as defined herein can be any elongated structure. "Slide gear" as defined herein is specifically defined to include any type of slidable interlocking structure, and may include a gear with an exterior star gearing, a single key or tooth exterior structure, or any other structure with which a ring gear may be fixed rotationally and with which a lock ring may be selectively fixed or free to rotate, include one having a ball-detent mechanism.

BRIEF DESCRIPTION OF THE DRAWINGS

A preferred embodiment of the present invention is described below by reference to the following drawings, in which.

DETAILED DESCRIPTION

Figure 1:
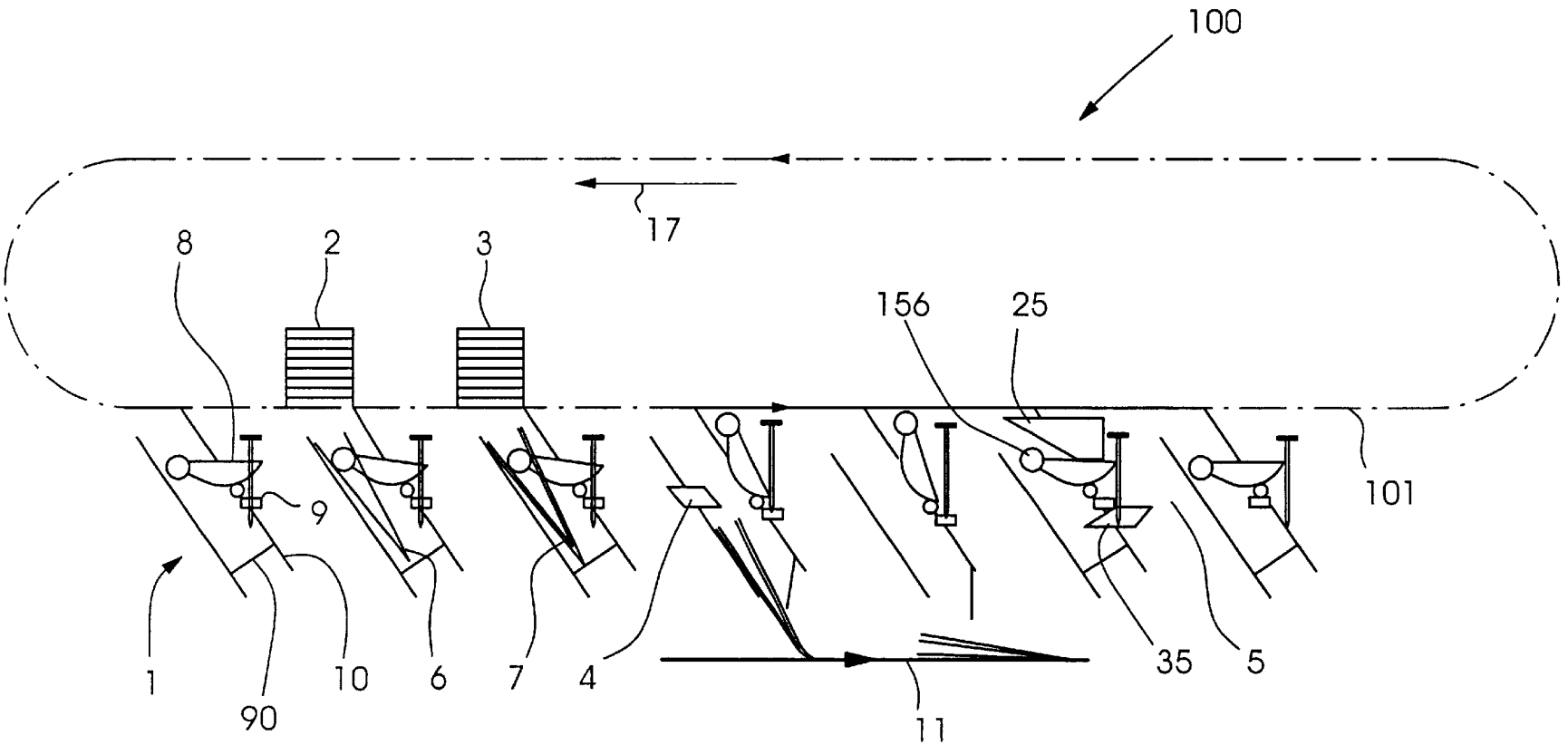
FIG. 1 shows a schematic view of a sheet material conveying apparatus according to the present invention.

FIG. 1 shows a schematic view of a sheet material conveying apparatus 100 having an endless track 101 for transporting a plurality of pockets 10 in direction 17. Each pocket 10 includes fingers 90 for defining a pocket height, an individual height setting mechanism 8 and a releasable lock mechanism 9 for the height setting mechanism 8.

At a setting area 1, each pocket 10 can be set manually by the setting mechanism 8 to move the fingers 90 to at least one of two desired heights, for example a setting for receiving 10½ inch folded products. The pockets 10 are stationary during setting, and the setting can occur outside the setting area as well, for example by an operator moving about track 101. Alternatively the pockets could be moved to the setting area, the apparatus stopped, and each pocket set. An automated robot for interacting with the setting mechanism also could be located at the setting area 1 to move each pocket to the proper height, as a pocket is moved to and stopped at the setting area 1.

After a pocket is set to a desired height, the setting mechanism 8 is engaged, as will be described with respect to FIGS. 8 to 10, to a locked lock mechanism 9 so that the pocket fingers 90 remain stationary. After all the pockets are set, the pockets 10 are moved to pass beneath a first sheet material delivery station 2 where, for example, a folded cover section 6 of a newspaper or other printed product is delivered into the pocket 10. At a second and optional sheet material delivery station 3, a second section may be inserted between the cover section 6 to form a final inserted and collated product 7.

The pockets 10 can then pass a release station 4 which releases lock mechanism 9. Setting mechanism 8, which is spring-loaded, then releases the fingers 90 so that the bottom of pocket 10 opens, and the products 7 are delivered, for example to a conveyor belt 11.

As pockets 10 continue past release station 4, pockets 10 pass through a reset station 5 which includes a movable incline reset ramp 25 for interacting with a reset cam follower 156 of setting mechanism 8 and a lock engagement device 35 for locking lock mechanism 9. The pockets 10, which are preferably all set to a common height, are then reset to the common height by the reset ramp 25, and locked into place by lock engagement device 35 engaging lock mechanism 9.

Figure 2:
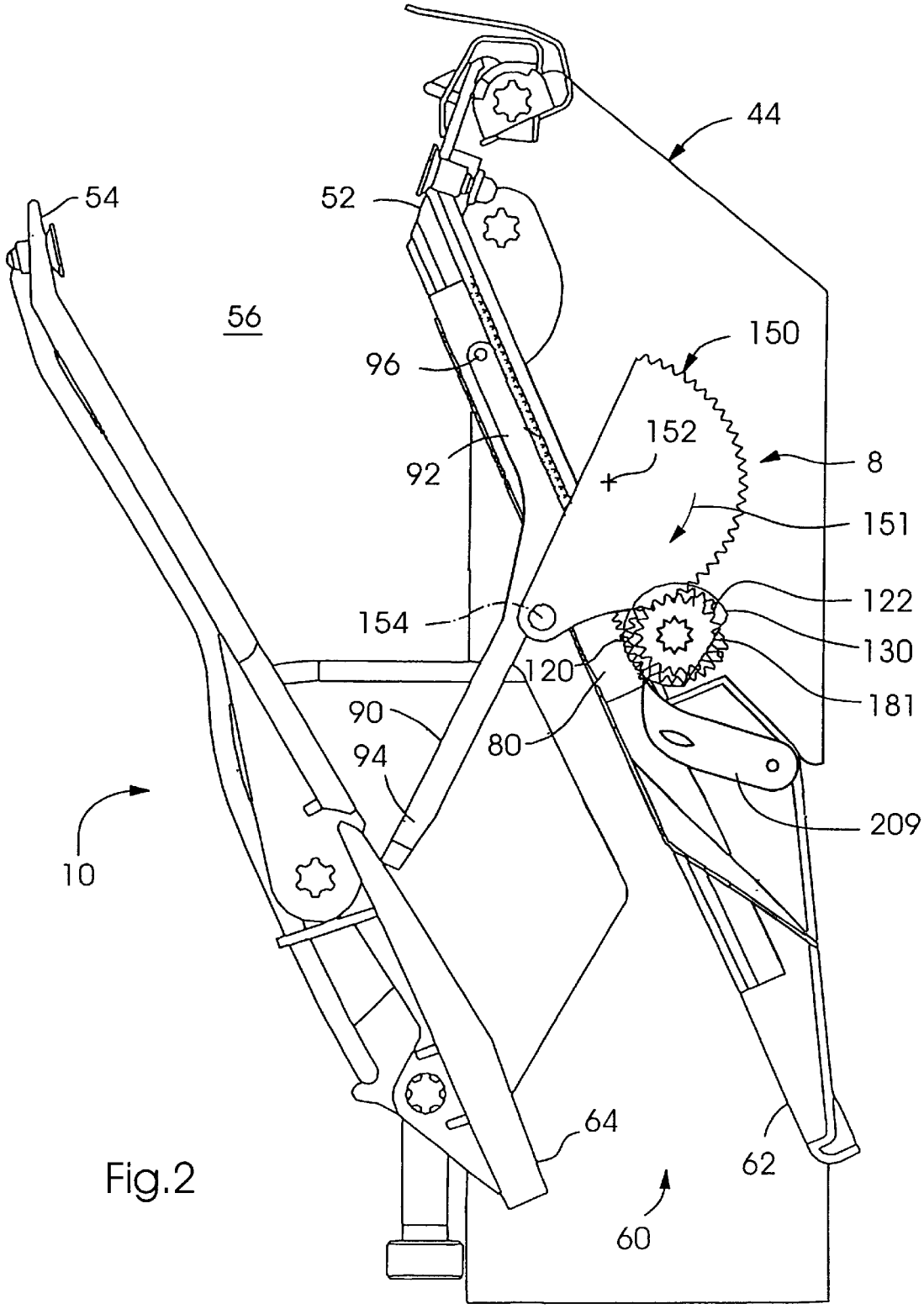
FIG. 2 shows a partial side view of a pocket according to the present invention, with certain elements omitted for clarity purposes.
Figure 3:
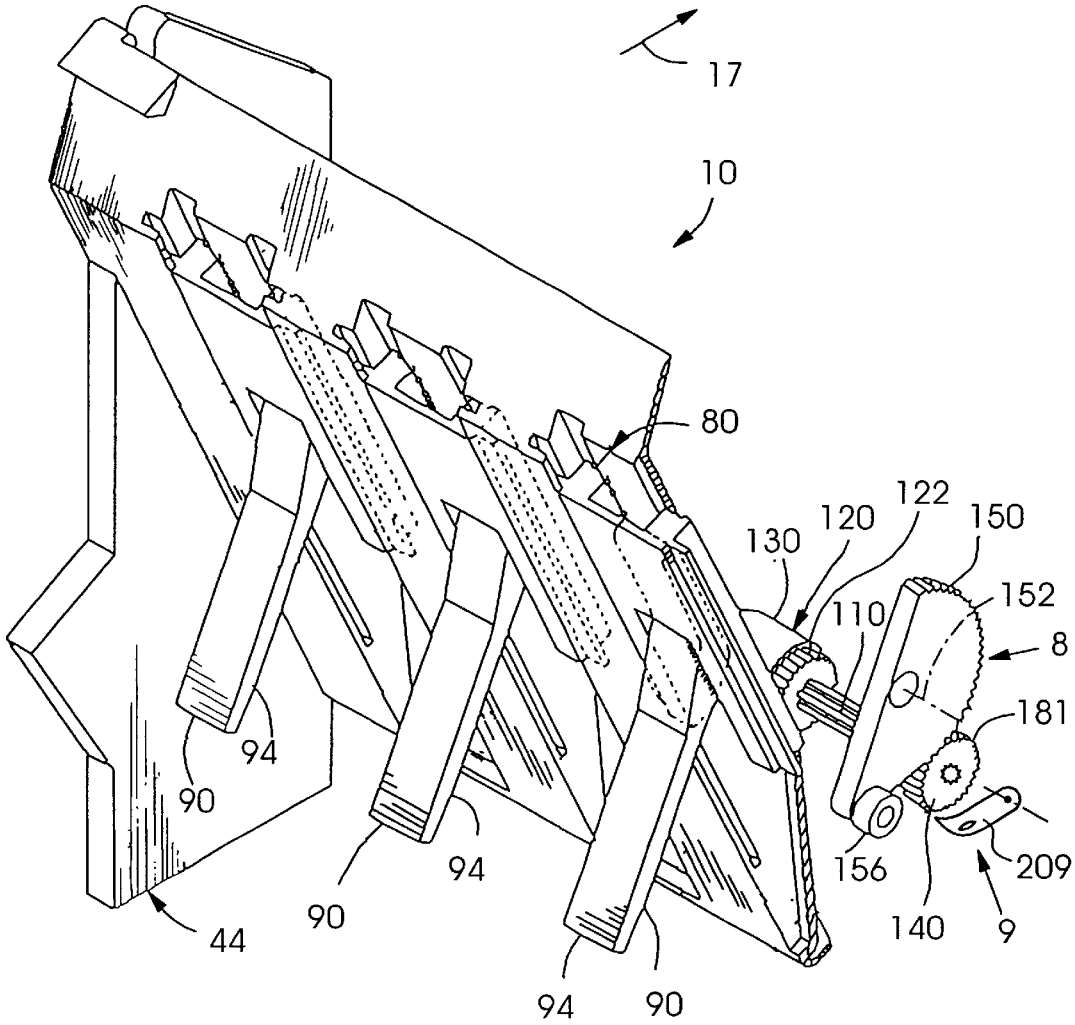
FIG. 3 shows a partial perspective view of a pocket according to the present invention with certain elements omitted for clarity purposes.
Figure 4:
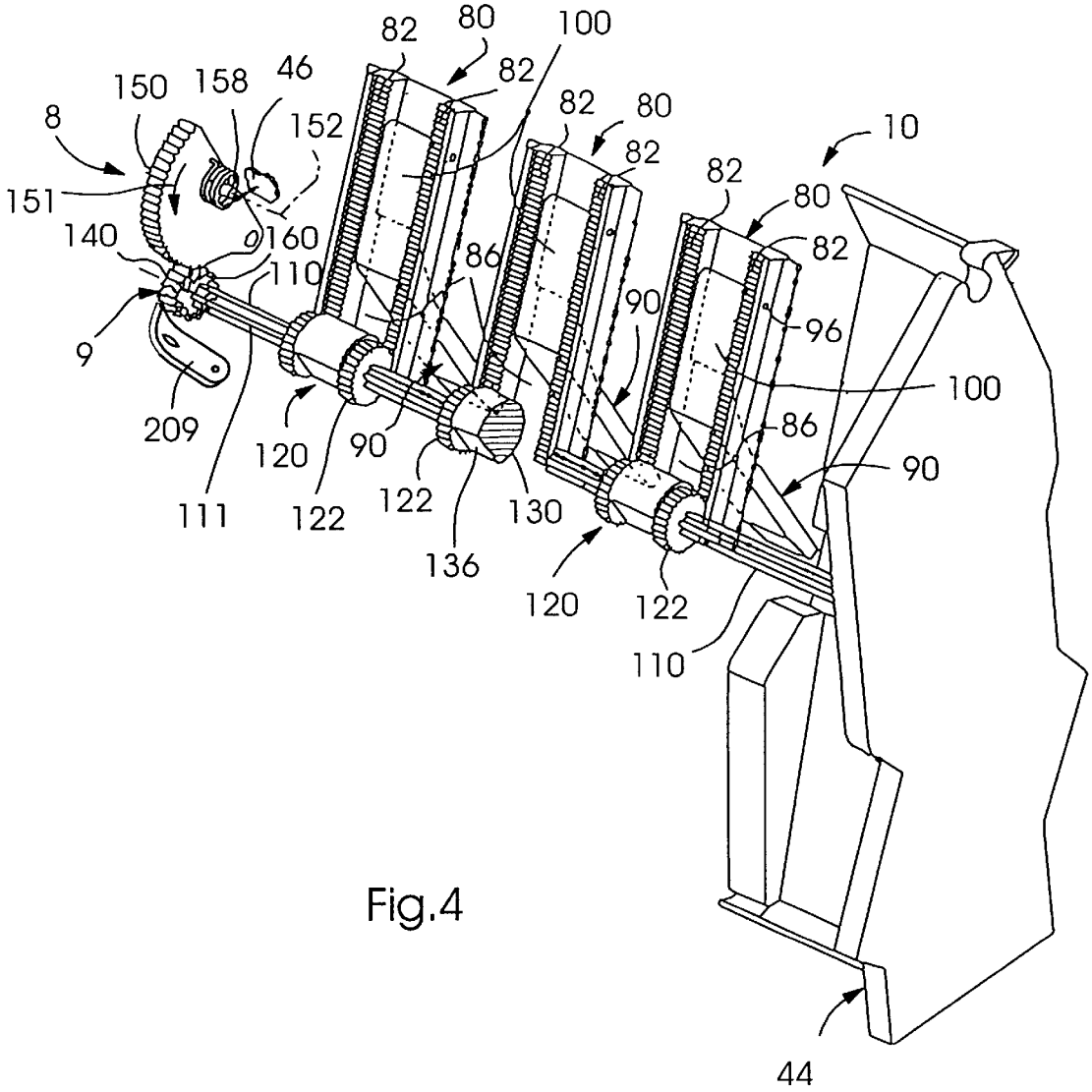
FIG. 4 shows another partial perspective view of a pocket according to the present invention with certain elements omitted for clarity purposes.

FIGS. 2, 3 and 4 show more details of pocket 10. Pocket 10 has an upper rear wall 54 and an upper front wall 52, in between which is an opening 56 for accepting sheet material, as well as a side wall 44. Pocket 10 also may have a lower rear wall 64 and a lower front wall 62. Slidable with respect to wall 52 is a rack 80, on which fingers 90 are supported. The fingers 90 are supported on rack 80 by a pivot 96 attached to a first section 92 of finger 90. A second section 94 of finger 90 can define a pocket bottom when fingers 90 are in a closed position. Rack 80 includes teeth 82 (FIG. 4) which interact with a gear 122 of a pinion 120 (FIGS. 3 and 4), which also includes a release cam 130. Pinions 120 are located on a shaft 110 rotatably supported in walls 44 and 46. At the wall 46 (FIG. 4, not fully shown to improve clarity), an end 111 of shaft 110 passes through a setting ring gear 140, of which only a first part is shown in FIG. 3. Ring gear 140 has an interior surface which ensures that ring gear 140 rotates in a fixed relationship with a slide gear 180 (FIG. 5), which is in a fixed rotational relationship with shaft 110. Slide gear 180 however can slide axially with respect to shaft 110 for selective interlocking with a lock ring 160 (interior to gear 140 and visible in FIG. 4), which forms part of lock mechanism 9. Lock mechanism 9 also includes a pawl 209 for interacting with a single ratchet on the exterior of ring 160. Ring gear 140 is shown in FIGS. 2, 3 and 4 only in part, with a second outer gear section 182 (FIG. 5) for interacting with a setting rod not being shown. The details of slide gear 180 and its interaction with ring gear 140 and lock ring 160 will be described in more detail with respect to FIGS. 5 and 6.

FIG. 3 shows how fingers 90 extend through the front wall. Release cam 130 can interact with a release surface 100 of finger 90 located in an opening 86 between teeth 82 when fingers 90 are fully lowered, so that the fingers rotate away from the rear wall and release any products in the pocket 10. Release of the fingers 90 is similar to the release of the feet in U.S. Pat. No. 5,911,416, the entire disclosure of which is hereby incorporated by reference herein.

FIG. 2 shows ring gear 140 interacting with a semicircular setting gear 150. On one side of semicircular gear 150 is a reset cam follower 156 held rotationally at an axis 154.

As shown in FIG. 4, semicircular gear 150 is attached to a spring 158 to spring-load gear 150 in a direction 151, as shown in FIG. 2.

Figure 5:
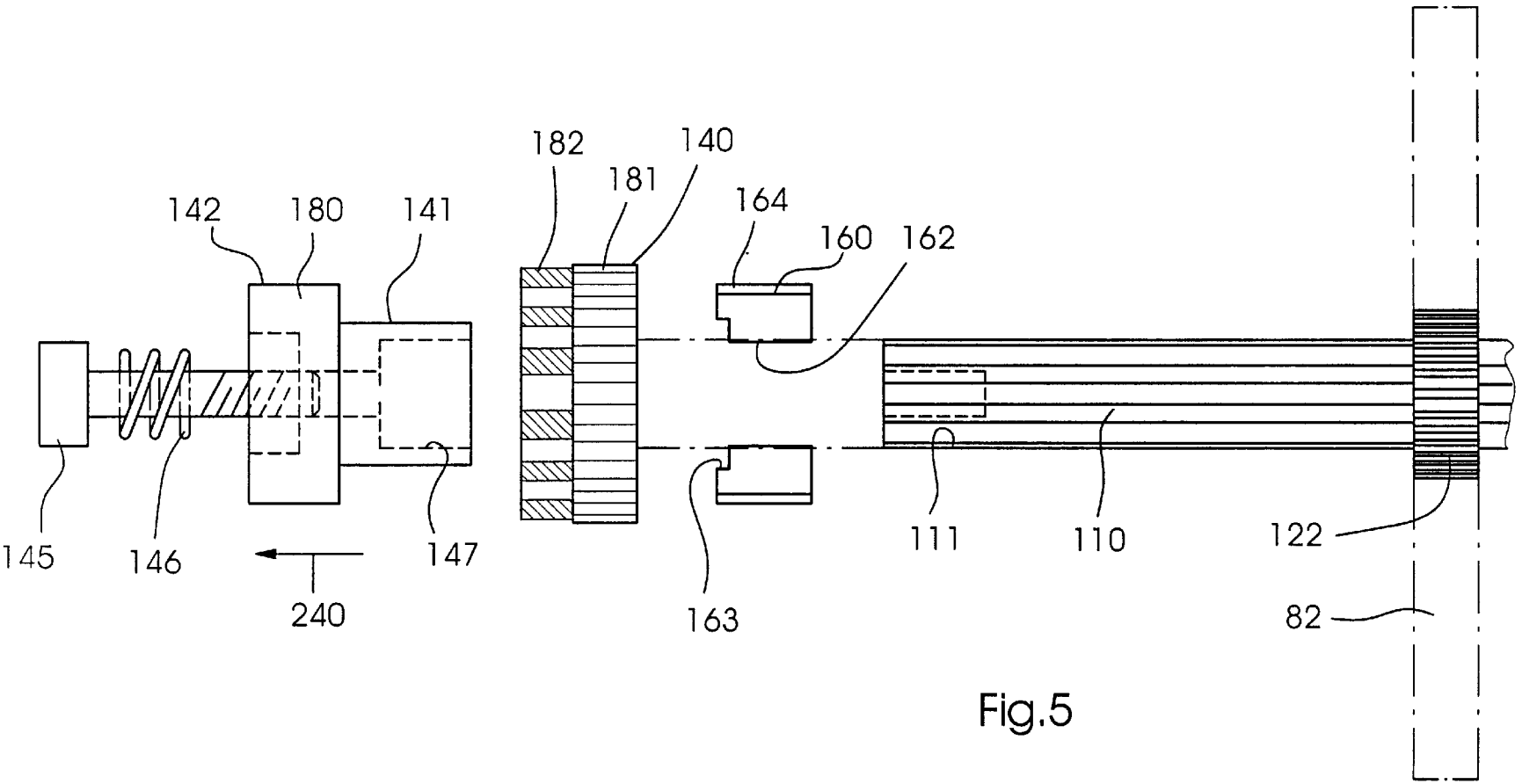
FIGS. 5 and 6 show more detail of the setting device for setting a finger height according to the present invention.
Figure 6:
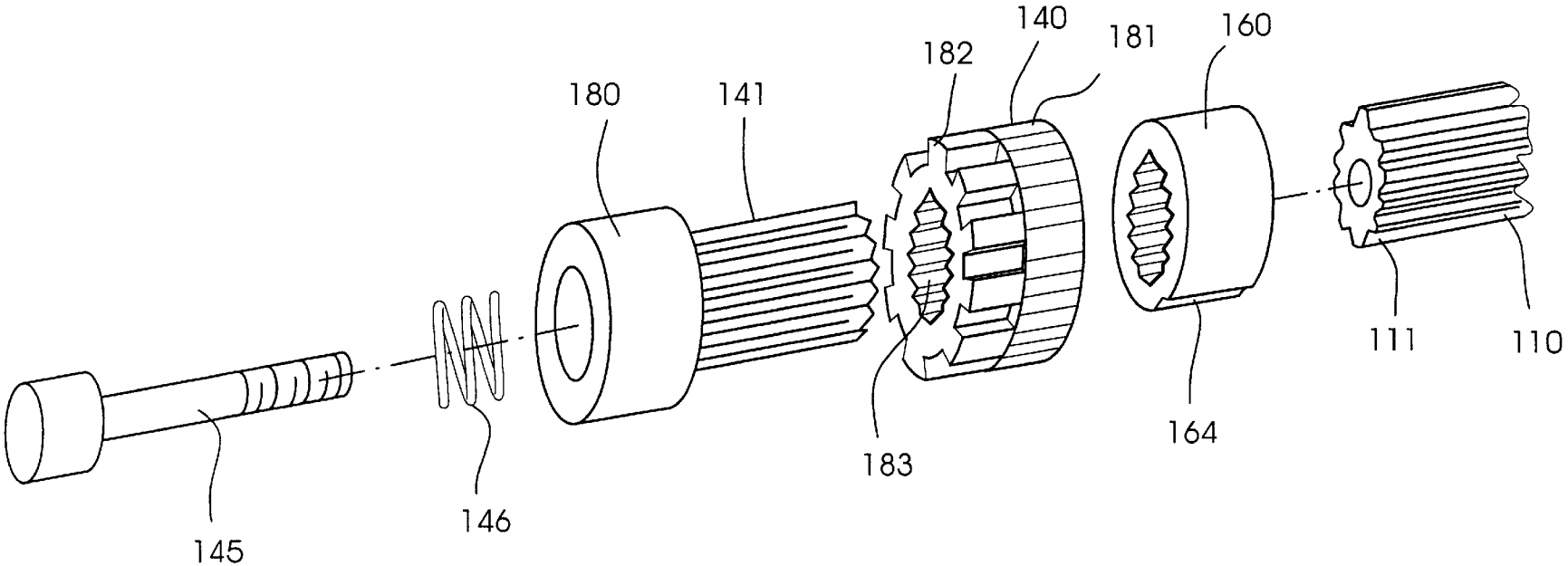

FIG. 5 shows an exploded view of certain details of the setting mechanism. End 111 of shaft 110 fits, passing through interior holes in ring gear 140 and lock ring 160, into an interiorly toothed hole 147 of slide gear 180. End 111 is fixed to a screw 145 which abuts slide gear 180 through a spring 146. Slide gear 180 thus can be moved against the force of spring 146 in the direction of arrow 240 so as to slide axially with respect to shaft 110, however always remaining rotationally fixed with shaft 110.

Slide gear 180 has exterior star gearing 141 with matches interior star gearing of ring gear 140. Slide gear 180 and ring gear 140 thus rotate together at all times. Interior to slide gear 180 and ring gear 140 is lock ring 160, which selectively engages, through an interior star gear 163, exterior star gearing 141 of slide gear 180 when slide gear 180 is not moved axially against the spring force of spring 146. When moved axially against the spring force in direction 240, slide gear 180 releases from lock ring 160, which then is held only by pawl 209 but is freely rotatable with respect to shaft 110 due to a smooth inner surface section 162 which rests on shaft 110.

Slide gear 180 has a raised portion 142 for interacting with a disengaging device of a setting rod to permit the slide gear 180 to be moved against the spring force of spring 146.

Figure 8:
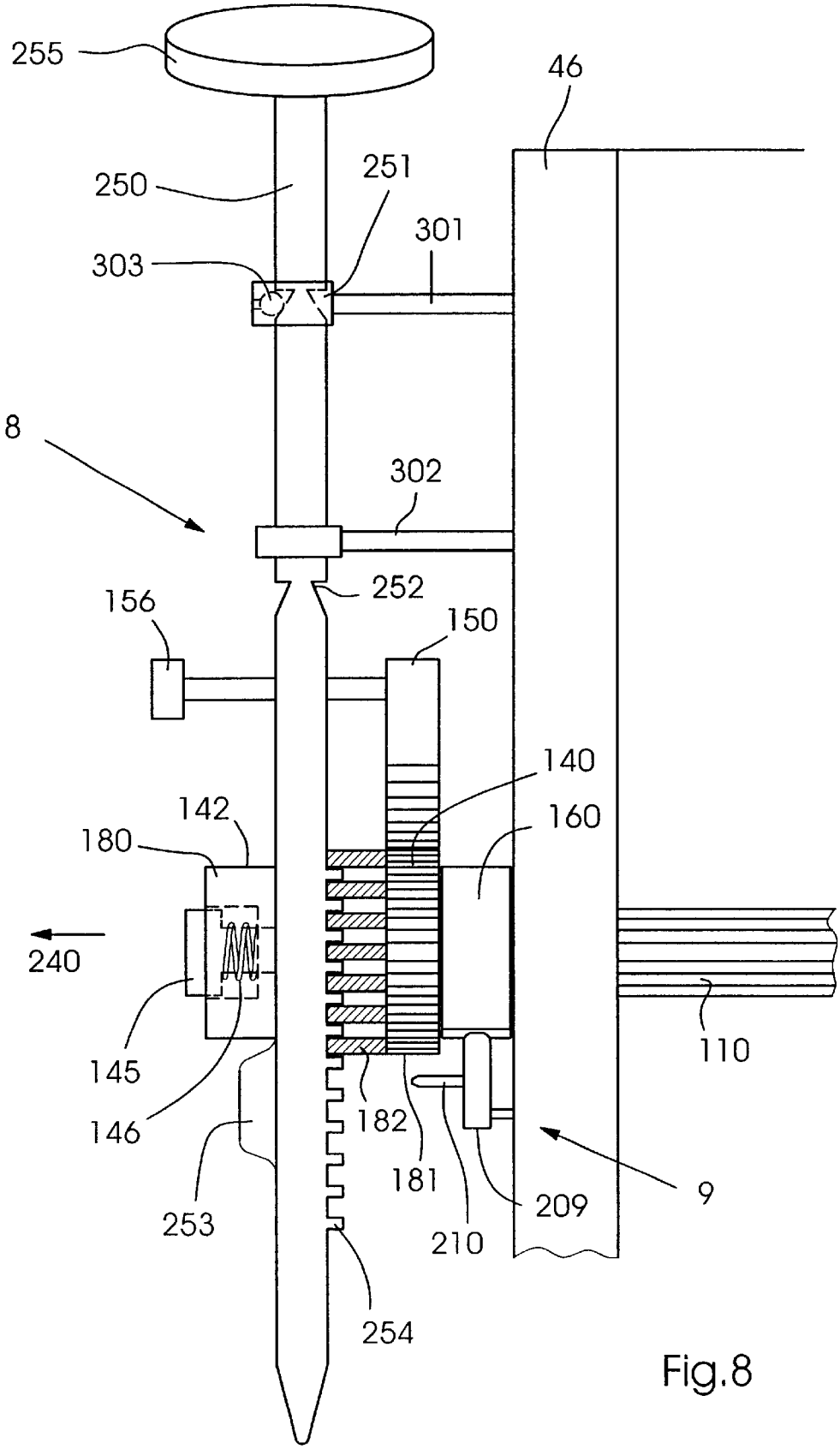
FIGS. 8, 9 and 10 show a partial front view of a first embodiment of the pockets of FIG. 1.

Ring gear 140 has external gear teeth 181 for interacting with semicircular gear 150 (FIG. 2), as well as external gear teeth 182 for interacting with the setting rod 250 (FIG. 8).

Figure 7:
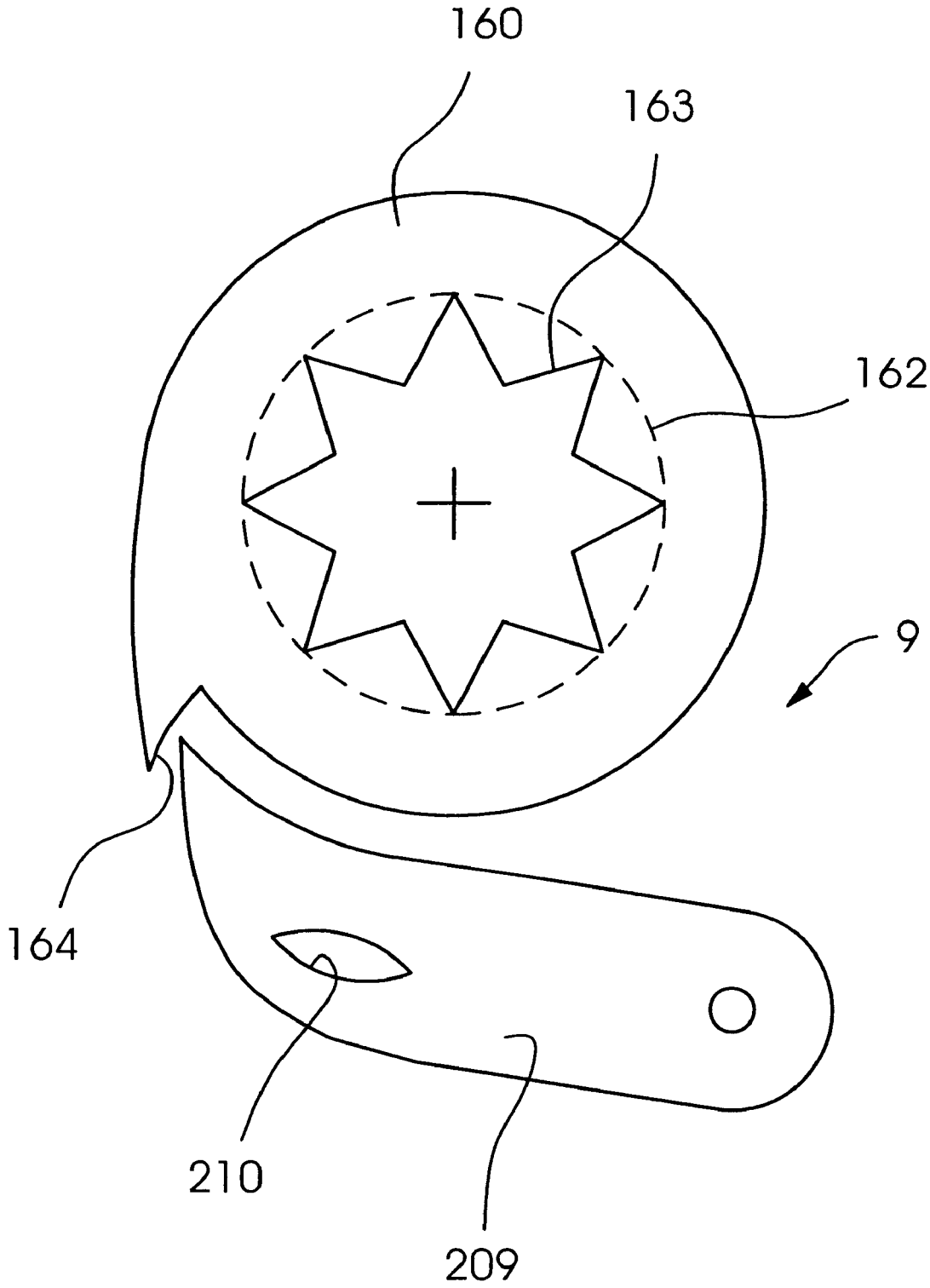
FIG. 7 shows more detail of the lock mechanism of FIG. 1.

Lock ring 160 has a single ratchet 164 on an external surface, which interacts with pawl 209, as shown in FIG. 7. An extension 210 extends outwardly from pawl 209, for permitting pawl 209 to move between an upward and a downward position. The pawl may be spring-loaded to favor one position, or to click into both positions.

Figure 9:
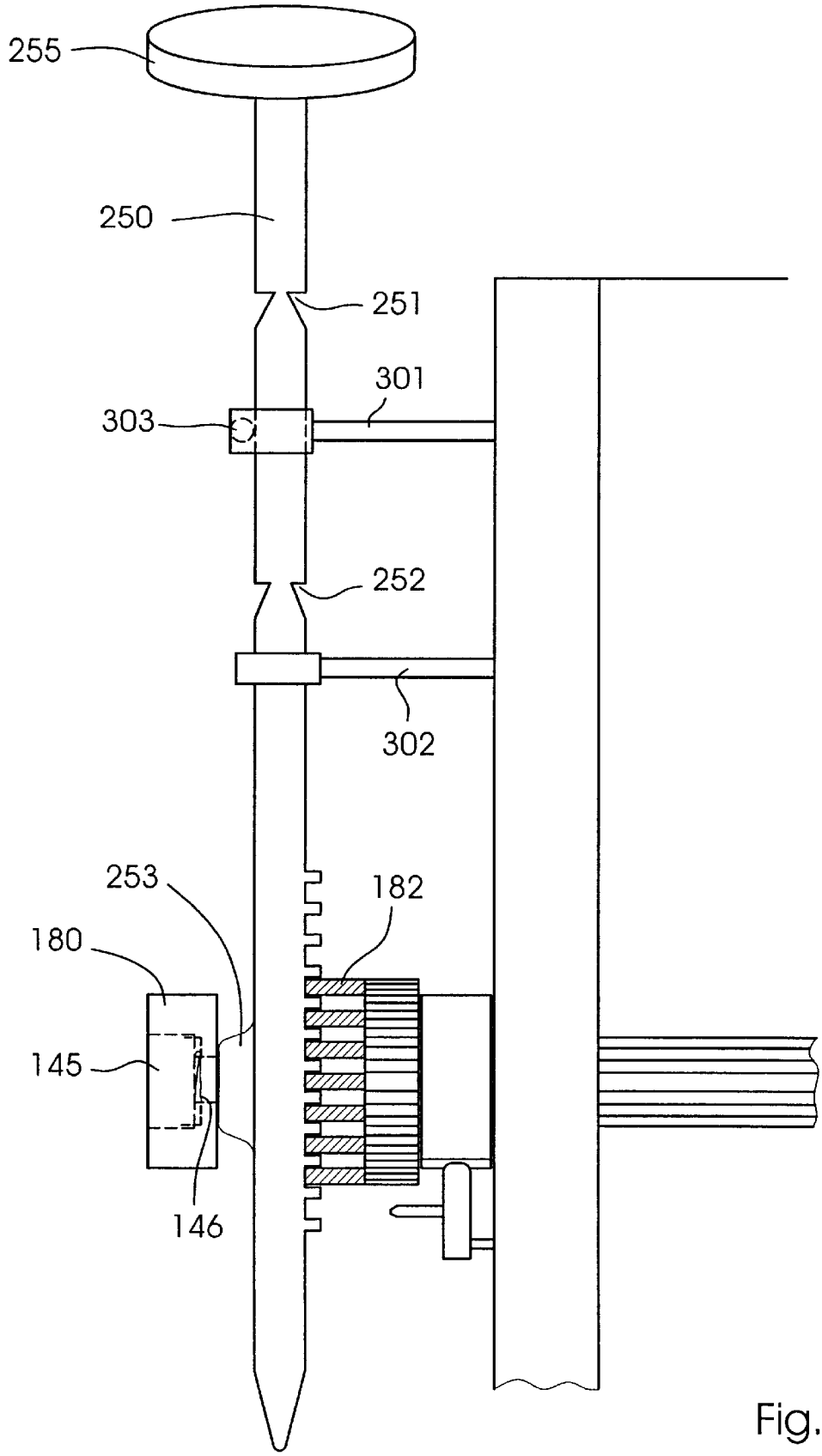
Figure 10:
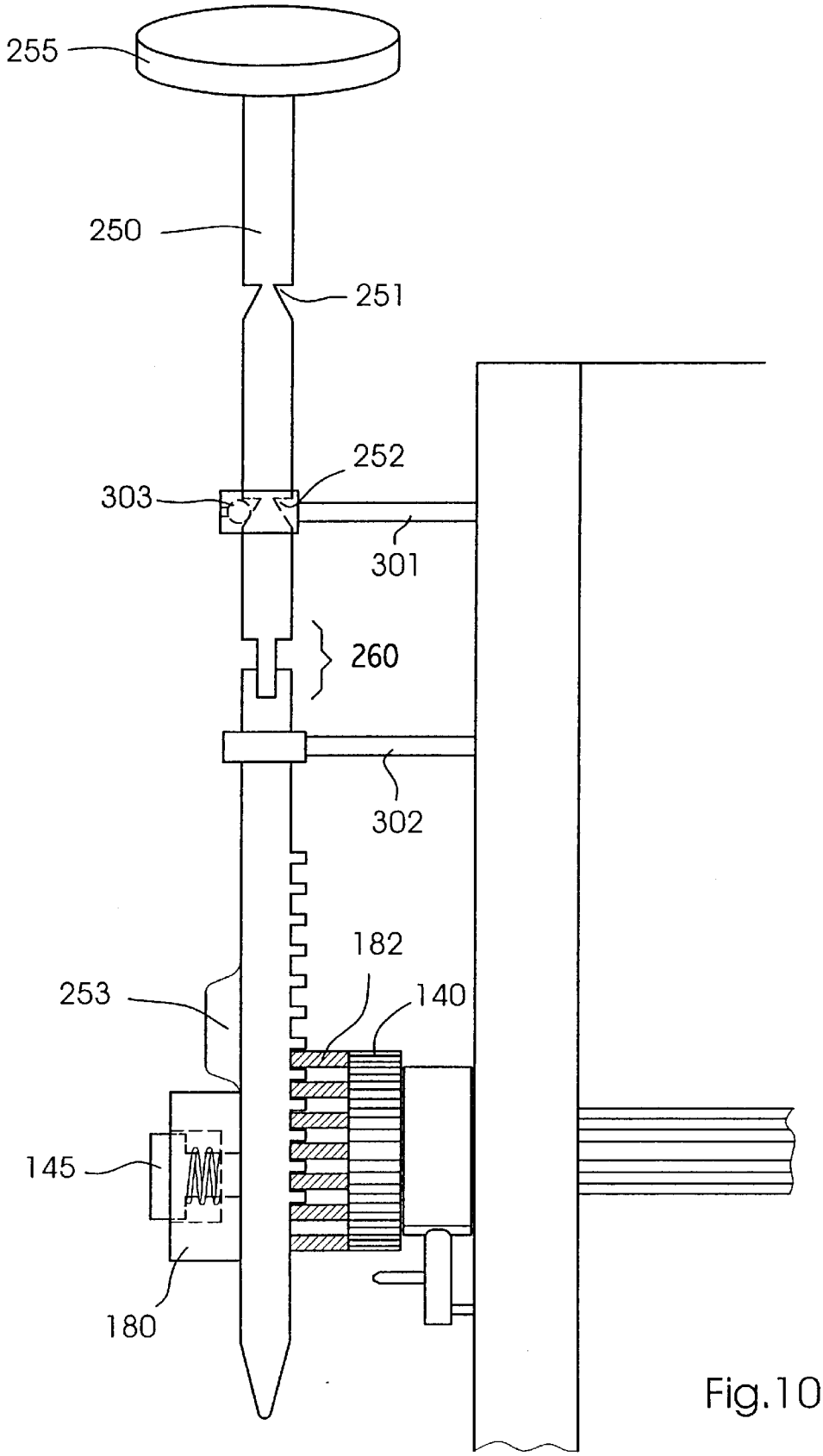

FIGS. 8, 9 and 10 show a setting action using a first embodiment of the setting device 8 of the present invention. In a first setting, a notch 251 of a setting rod 250 interacts with a ball detent 303 held in a first rod support 301. Ball detent 303, a spring-loaded ball, is loaded so that an operator can feel the setting, but does not prevent rod 250 from moving axially if sufficient manual force is applied to the rod 250. An operator thus can grip a handle 255 for pulling rod 250 upwardly with respect to support 301 and with respect to a second support 302, both of which are fixed to a side wall 46 of the pocket.

At a lower end of rod 250 are teeth 254 which interact with the gearing 182 of ring gear 140. For example, three of the teeth 254 may partially to fully engage with the gearing 182 so as to be able to rotate gear 140, and thus rotate shaft 110 and move the fingers 90. An upward movement of rod 250 moves fingers 90 downwardly, and visa versa. When rod 250 is in an uppermost position, the fingers release so that the bottom of the pocket opens.

On a side of rod 250 is a disengaging device 253 which in the embodiment of FIG. 8 comprises a raised cam 253 which interacts with an interior surface of raised portion 142 of slide gear 180.

Pulling the rod 250 upwardly thus causes follower gear 180 to move outwardly in direction 240 through the action of cam 253, and against the spring force of spring 146, as shown in FIG. 9. At the same time, ring gear 140 is rotated by teeth 254, so that pocket fingers 90 move downwardly. The pocket thus can accept larger formatted sheets.

Figure 11:
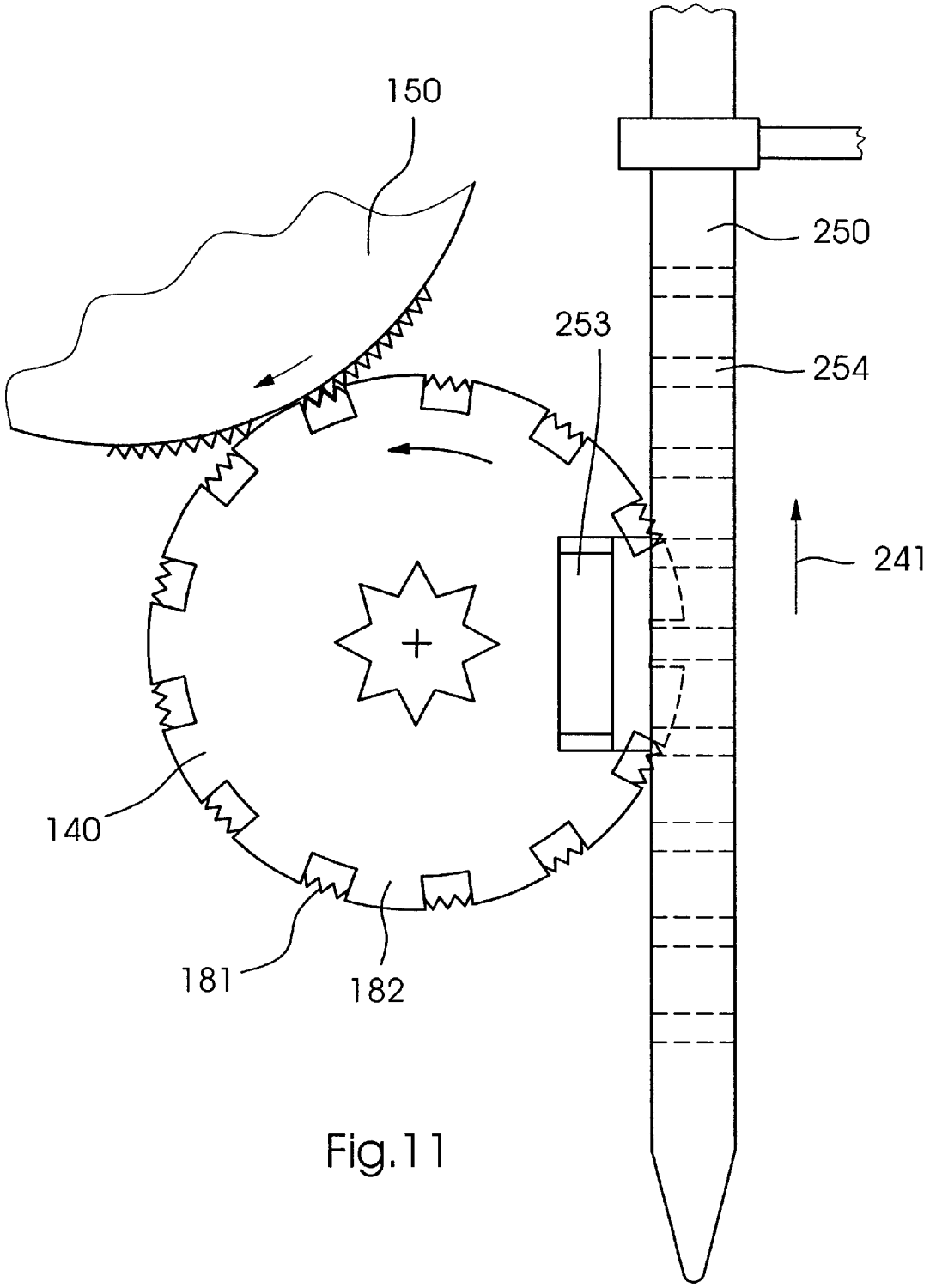
FIG. 11 shows more detail of the interaction of the first embodiment of the pockets of FIG. 1.

FIG. 11 shows this movement, with upward direction 241 causing gear 140 to move in direction 242 which rotates shaft 110 in the same direction, and thus rack 80 and fingers 90 (FIG. 2) downwardly.

At the same time as the pocket fingers 90 and shaft 110 are moving, lock ring 160 and pawl 209 can remain stationary, which permits for proper resetting of the height at the reset station 5 (FIG. 1). The incline ramp 25 of station 5 is also reset when the pocket height is changed.

As shown in FIG. 10, when a second notch 252 reaches ball detent 303, the second setting is reached. At the same time cam 253 releases slide gear 180 so that the lock ring 160 is re-engaged to slide gear 180.

More than two settings can be provided by the rod 250, with an extra cam and notch being necessary for each new setting.

The embodiment of FIGS. 8 to 11 provides a single one step setting device for easy manual changing of the pocket height. Moreover, the simple push-pull movement is well suited to robotic interaction. Thus a robotic arm could be used to set the pocket height of each pocket at station 1, with each pocket being moved, stopped and with rod 250 being gripped and moved to a predetermined distance by the robotic arm.

The setting rod also may have a fine tuning mechanism 260 (FIG. 10) consisting of a crew-type arrangement, by which the distance between the notches 251, 252 and the cam 253 can be varied. The lower part of rod 250 can be held fixedly by one hand of an operator and the top part of rod 250 rotated to vary the distance. Alternately, the top part of rod 250 could have a screw and the bottom part a sliding nut and fixed housing to provide for single hand fine tuning. A tension spring could also be provided between the two parts to provide a counter force to the screw action.

Figure 12:
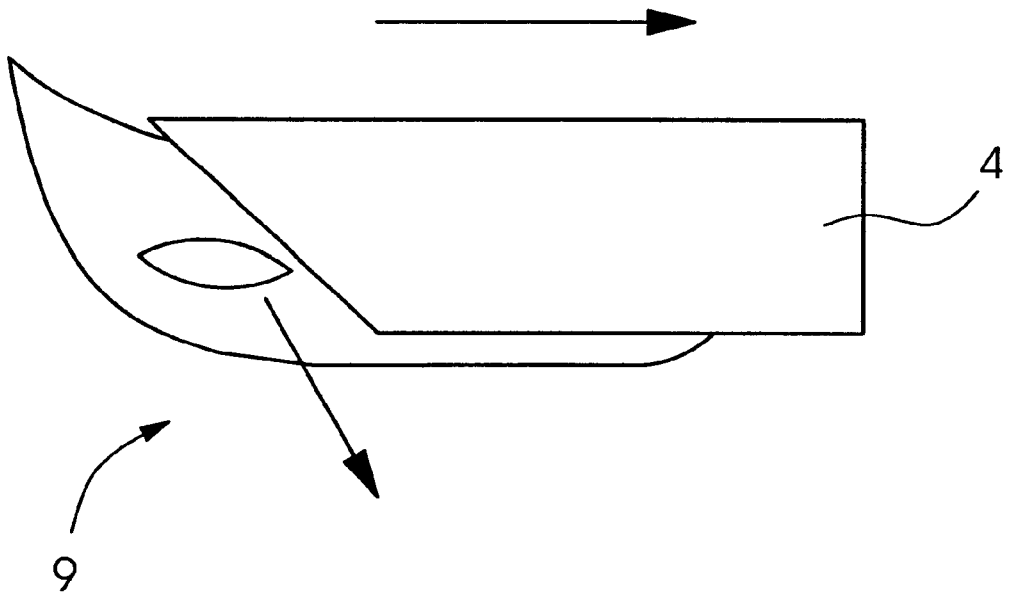
FIG. 12 shows more detail of the release station of FIG. 1

FIG. 12 shows the release station 4, which moves pawl 209 of lock mechanism 9 downwardly to a released position as a pocket passes station 4 in direction 17. Pawl 209 thus moves away from ratchet 164, by the interaction of a sloped surface 304 of station 4 forcing extension 210 downwardly. Once pawl 209 moves downwardly, lock ring 160 moves counterclockwise (FIG. 7). This counterclockwise movement occurs because of the spring loading of semicircular gear 150 in direction 151 (FIG. 2), which rotates knob gear 140 counterclockwise (FIG. 2). Since lock ring 160, ring gear 140, slide gear 180 and shaft 111 are all rotationally fixed at the release station, they all rotate together. Shaft 111 thus moves fingers 90 downwardly through gear 122 and rack 80 until cams 130 cause the fingers to open and release the sheet material in pocket 10.

Figure 13:
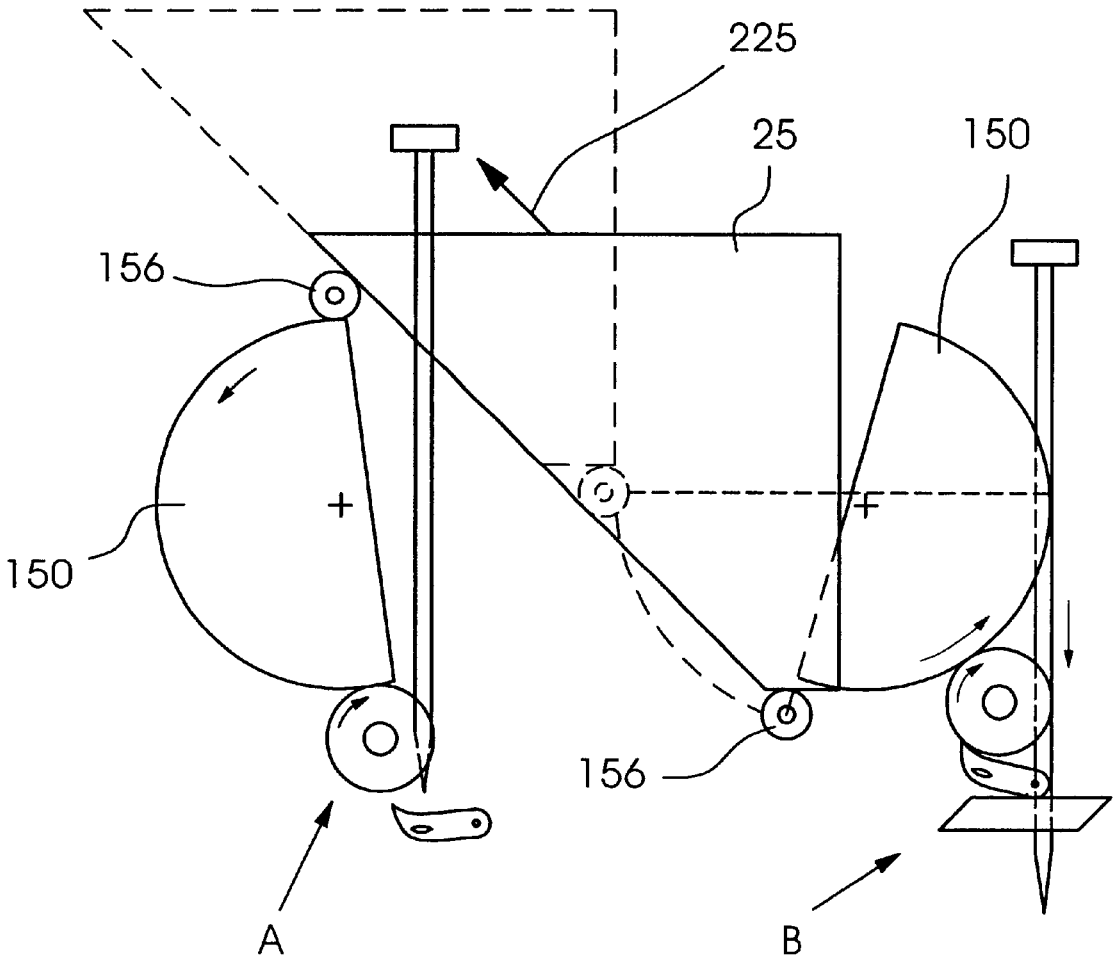
FIG. 13 shows more detail of the reset station of FIG. 1.

Once released, the pockets 10 are in a position A as shown in FIG. 13, with the reset cam 156 at a top position. As pocket 10 moves past reset station 5, reset cam 156 is forced downwardly by incline ramp 25 to original set position B. Because the reset ramp 25 is set to the proper height, the single ratchet 164 of lock ring 160 is in the proper position at the bottom of ramp 25 for a lock engagement device 35 to move the extension 210 of pawl 209 upwardly and engage ratchet 164. The pockets 10 thus are properly reset to the closed position for continuous operation around track 101 without any stopping or cessation necessary.

The reset ramp 25 preferably should be set to a height corresponding to a common pocket height of all pockets. Reset ramp 25 can be moved incrementally in direction 225. Thus if the pockets 10 are all reset for a different pocket height, reset ramp 25 should be moved to a position corresponding to the different pocket height. Dotted lines in FIG. 13 show a second reset ramp position for a different pocket height. In this case, the cam 156 is not moved as far downwardly, so that the fingers are not moved upwardly as much and the pocket height (depth) is greater; for example, resetting the height for 12 inch folded products instead of 10½ inch folded products.

If the ramp is not set for a proper reset height, the pawl 209 will not engage directly at the single ratchet and thus the ring will rotate until the pawl contacts the single ratchet. This rotation may cause damage to lock ring 160 (if the ramp is set too low) or may cause improper setting of the pocket height (if set too high).

Operation of the apparatus 100 may be summarized as follows:

With the apparatus in a stationary position, for each pocket 10, setting rod 250 is moved to one of two notch positions where ball 303 engages either notch 251 or 252 with pawl 209 engaging lock ring 160. The setting should be the same for each pocket 10. All of the pockets 10 thus are locked at their desired set height. The incline ramp 25 is then set to correspond to the common height for the pockets.

The pockets 10 then receive sheet material from delivery stations 2 and 3. When ready for release, the pockets pass by release station 4, which causes the pawl 209 to release and the pocket fingers to move downwardly and release the indexed or collated sheet material 7.

The pockets are then reset at reset station 5, by cam follower 156 moving downwardly along ramp 25 to move the fingers 90 up to the proper height. Lock engagement device 35 moves pawl 209 back to lock lock ring 160 and the fingers 90 in the proper height.

The apparatus can thus continue operating at the set height. If a new set height is desired, the machine is stopped and each pocket 10 and the incline ramp 25 reset to a new height.

Figure 14:
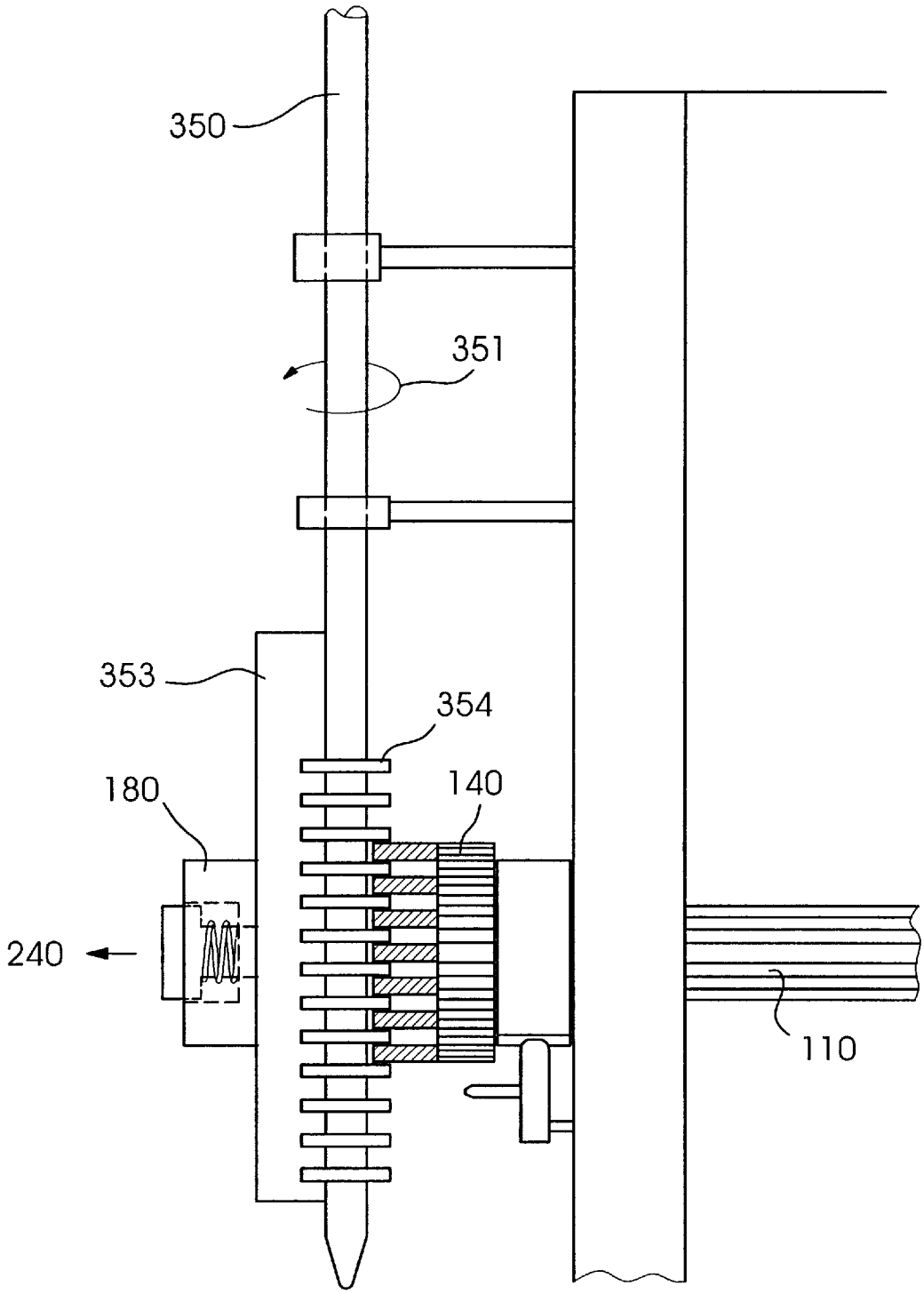
FIGS. 14 and 15 show more detail of a second embodiment of the pockets of FIG. 1 with a cam blade mechanism.
Figure 15:
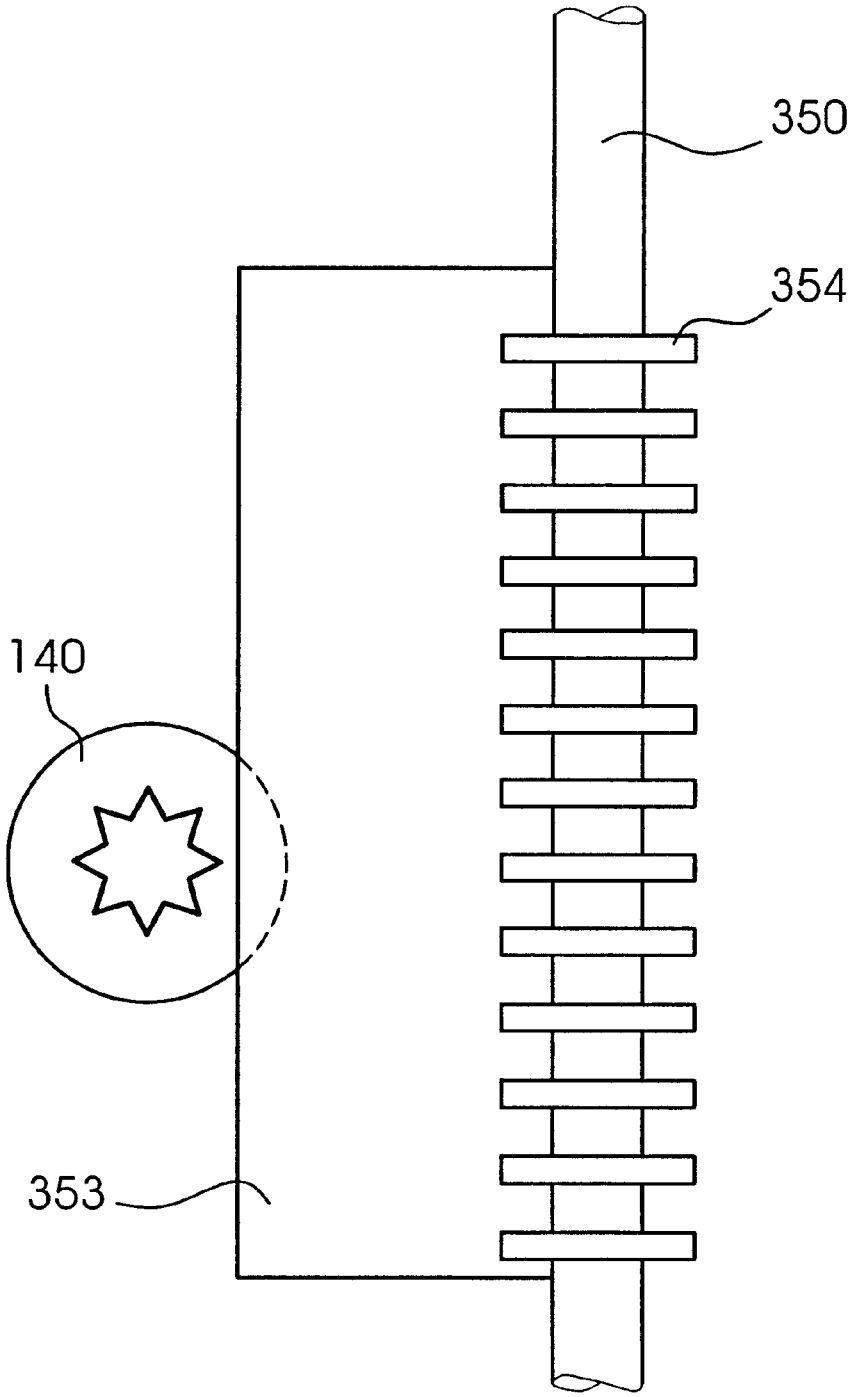
Figure 16:
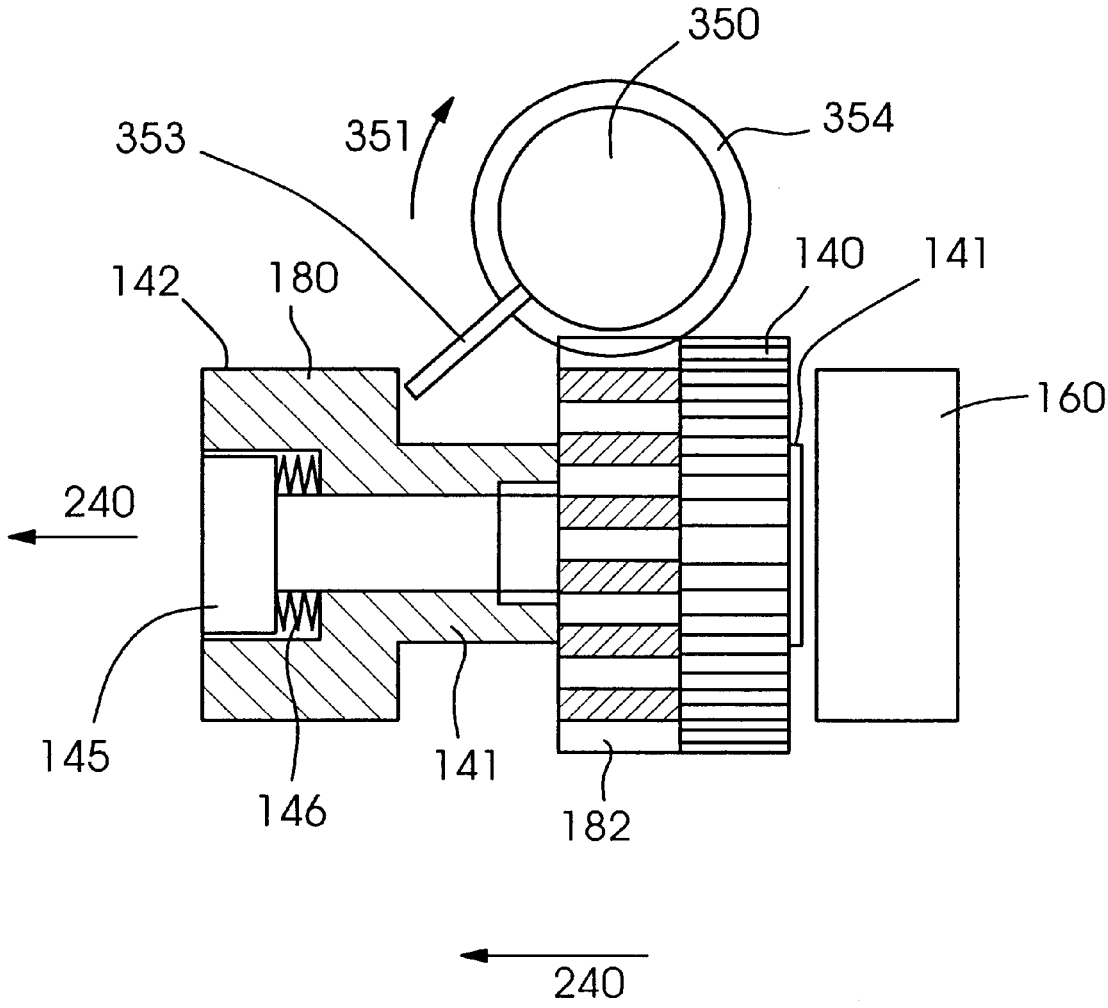
FIG. 16 shows a bottom view of details of the second embodiment.

FIGS. 14, 15 and 16 show a side view, front view and rear view respectively of a second embodiment in which the setting rod can be used to set a wide variety of heights. A setting rod 350 has circular teeth 354 at a bottom end which interact with teeth 182 of ring gear 140 to set a pocket height, similar to the first embodiment. However, the disengaging device of the second embodiment is a cam blade 353 which fits between the ring gear 140 and the raised portion 142 of slide gear 180. Thus to set the pocket height. An operator first twists rod 350 in direction 351 to move slide gear 180 in direction 240 by operation of cam blade 353. This star gearing 141 disengages lock gear 160 (which is held in place by a pawl), as shown in FIG. 16. The rod 350 can then be slid up or down to a variety of positions to change the pocket height. The rod 350 can then be turned back opposite direction 351 (or be forced by the action of spring 146, which pushes slide gear 180 in a direction opposite direction 240) so as to lock in the new pocket height. An indicator, for example on semicircular gear 150, could indicate the actual pocket height.

Figure 17:
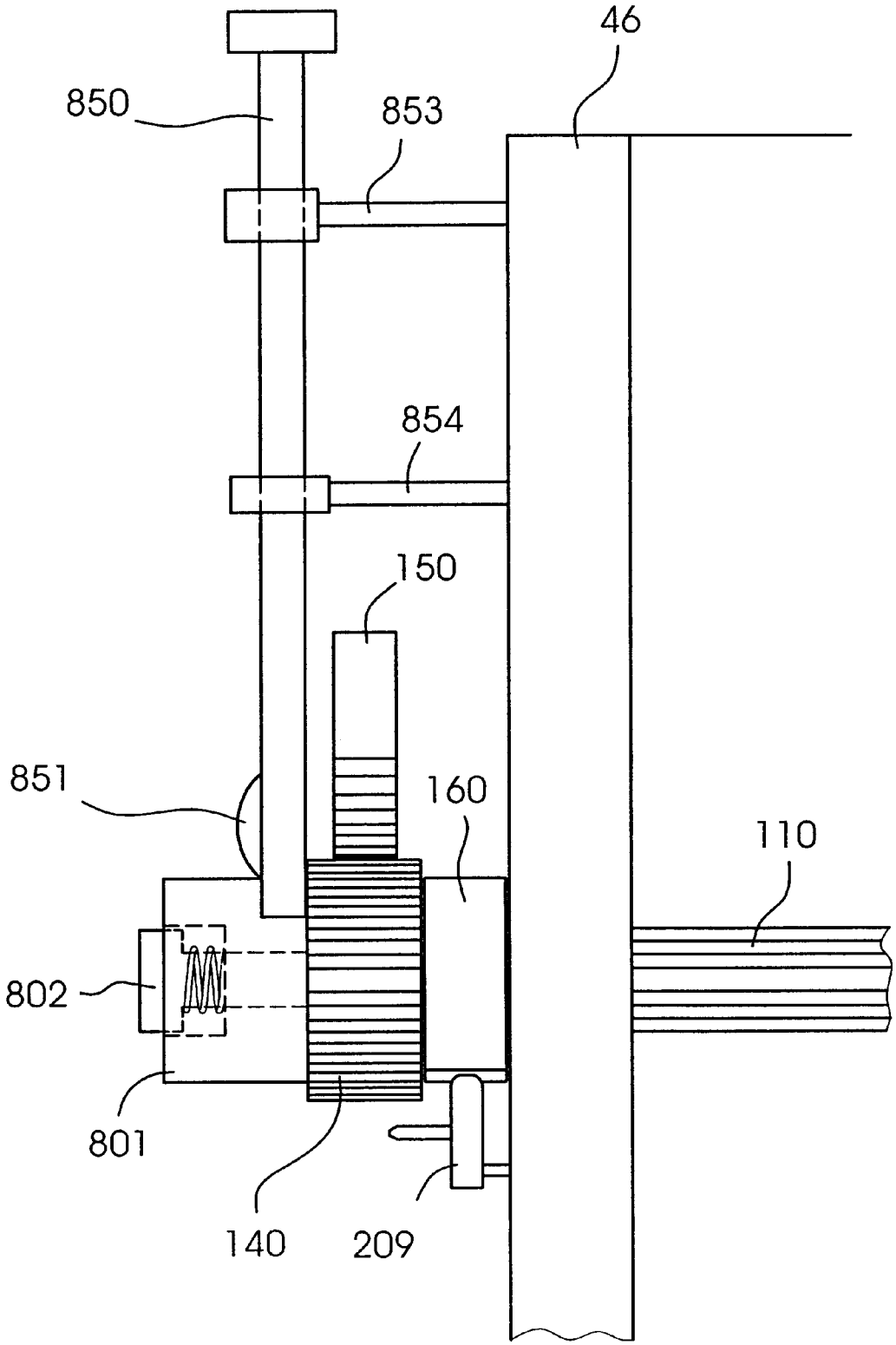
FIGS. 17 and 18 show details of a second embodiment using a two rod mechanism, one rod including a worm gear.
Figure 18:
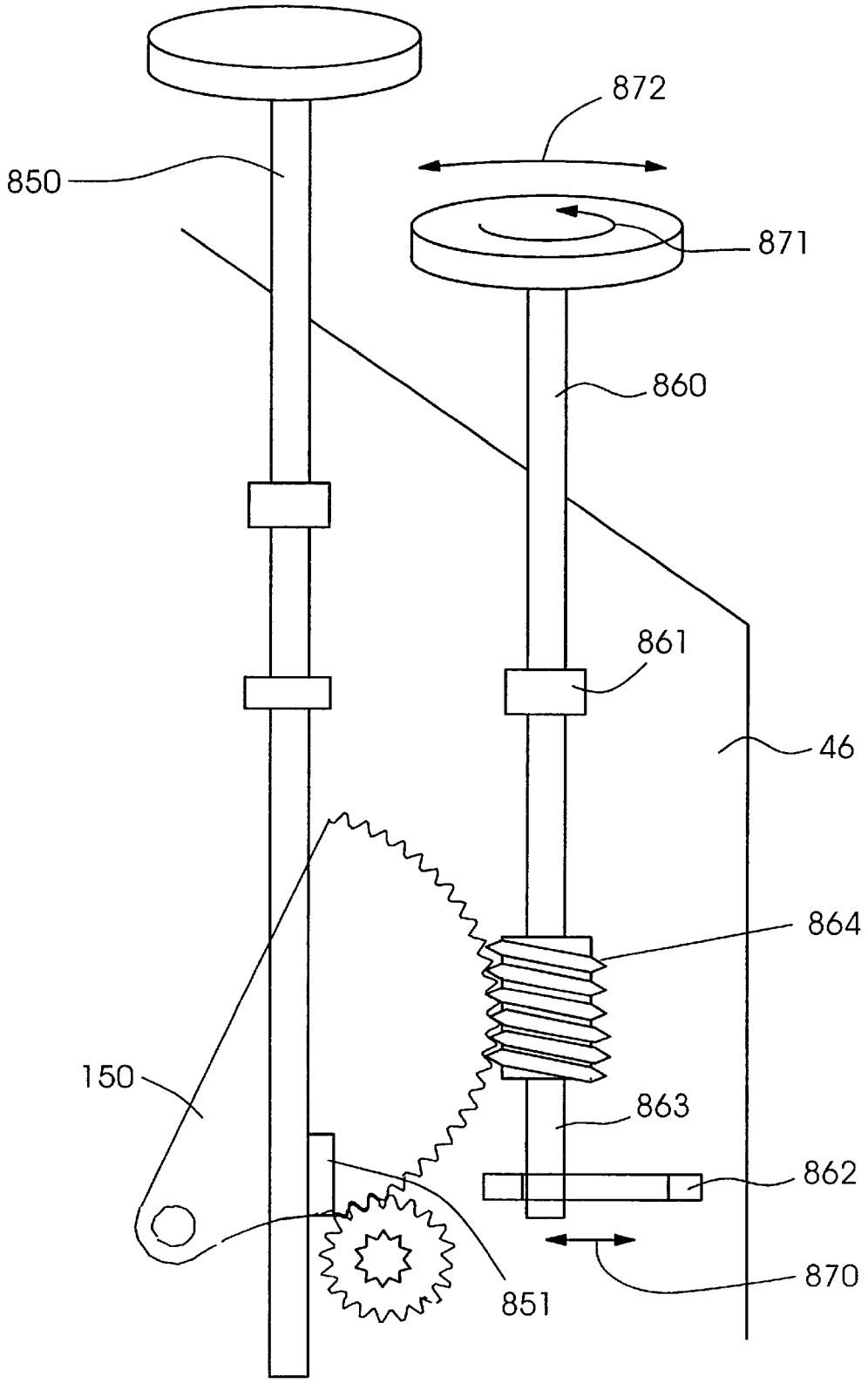

FIGS. 17 and 18 show a further embodiment with a two rod configuration, including rods 850 and 860. Rod 850 is a cam rod having a cam 851 similar to cam 253 for disengaging a star gear 801 with lock ring 160. Rod 850 moves up and down with respect to supports 853 and 854 is used solely to release star gear 801 by having cam 851 push star gear 801, to the left in FIG. 17. Rod 860 is a setting rod which is supported pivotally in pivot support 861, which is connected to pocket wall 46. Rod 860 has a lower end 863 and a worm gear 864. Lower end 863 can move in a support 862 fixed to wall 46, support 862 having a slot in which lower end 863 can move between two positions. In an engaged position, worm gear 864 of rod 860 engages semicircular gear 150. By rotating setting rod 860 in direction 871 when star gear 801 is disengaged by rod 850, the gear 150 can be moved through worm gear 864 so as to set a pocket height. Once the desired height is achieved, an operator can rotate the rod 860 about pivot 861 as indicated by arrows 870 and 872. Worm gear 864 thus disengages gear 150, and rod 860 can be locked in the disengaged position. Rod 850 can be moved so that cam 851 no longer acts on gear 801, and star gear 801 again engages lock ring 160. The pockets may then be transported and reset as with the embodiments described above. This embodiment has the advantage that the rods 850 and 860 need not move during the resetting step.

"Ramp" as defined herein can include any cam shaped for moving a cam follower in a desired direction. "Ratchet" as defined herein can include any stop for a pawl or similar device to a pawl. "Lock ring" as defined herein can include any locking device.

What is claimed is:

1. A sheet material conveying apparatus comprising:

a plurality of pockets, each pocket including a setting device for adjusting a height of the pocket so as to define a set height, the setting device including a setting or cam rod, a ring gear having an outer surface connected to the setting rod, and a lock ring selectively releasable from the ring gear, the setting or cam rod including a disengaging device for releasing the lock ring from the ring gear during a setting operation.

2. The apparatus as recited in claim 1 further comprising a reset station including a movable reset incline ramp and a lock engagement device.

3. The apparatus as recited in claim 1 farther comprising a slide gear rotationally fixed with respect to the ring gear, and selectively releasable from the lock ring.

4. The apparatus as recited in claim 3 wherein the disengaging device includes at least one raised cam section for moving the slide gear away from the lock ring.

5. The apparatus as recited in claim 1 wherein the lock ring includes a single point ratchet and the pocket further includes a pawl for interacting with the lock ring.

6. The apparatus as recited in claim 1 wherein the setting rod includes at least two preset height notches for permitting an operator to set the pocket height to two different settings.

7. The apparatus as recited in claim 6 wherein the notches interact with a rod support, the rod support being connected to a pocket wall.

8. The apparatus as recited in claim 1 wherein the disengaging device includes at least one raised cam section.

9. The apparatus as recited in claim 1 wherein the setting rod includes a fine adjustment mechanism.

10. The apparatus as recited in claim 1 wherein the disengaging device includes a cam blade.

11. The apparatus as recited in claim 1 wherein the setting rod includes curved teeth.

12. The apparatus as recited in claim 1 wherein the setting rod includes gear teeth.

13. The apparatus as recited in claim 1 wherein the ring gear has a first outer gear section geared to a spring loaded semi-circular gear and a second outer gear section geared to the setting rod.

14. The apparatus as recited in claim 13 wherein the ring gear is rotationally fixed to a slide gear through interior star gearing, the slide gear being rotationally fixed to a shaft.

15. The apparatus as recited in claim 14 wherein the lock ring fits around the shaft, and the slide gear is selectively engageable with the lock ring, by sliding of the slide gear axially with respect to the shaft.

16. The apparatus as recited in claim 1 wherein the setting device includes a setting and a cam rod, the setting rod being pivotable about a pivot support connected to one of the plurality of pockets.

17. A sheet material pocket comprising:

a first wall;

a second wall spaced apart from the first wall so as to define a sheet material opening;

at least one finger movable with respect to the first wall for defining a pocket bottom, the at least one finger releasable so that the pocket bottom opens;

a shaft connected to the at least one finger for moving the at least one finger;

a slide gear rotationally fixed with respect to the shaft and slidable with respect to the shaft;

a ring gear rotationally fixed with respect to the slide gear; and a lock ring selectively engageable with the slide gear.

18. The pocket as recited in claim 17 further comprising a slidable setting rod geared to the ring gear, the setting rod including a disengaging device.

19. The pocket as recited in claim 18 wherein the disengaging device includes a raised cam for moving the slide gear.

20. The pocket as recited in claim 18 wherein the disengaging device includes a cam blade actuated by a rotation of the setting rod.

21. A method for setting a height of a sheet material pocket comprising the steps of:

sliding a rod while the pocket is stationary to move fingers of the pocket so as to set the pocket to a set height;

moving a gear axially with the rod, the gear thus disengaging a lock mechanism, the lock mechanism remaining fixed during setting; and re-engaging the gear with the lock mechanism.

22. The method as recited in claim 21 where in the rod is moved between at least two predetermined positions.

23. A method for setting a height of a sheet material pocket comprising the steps of:

moving a first rod while the pocket is stationary to move fingers of the pocket so as to set the pocket to a set height;

moving a gear axially with a second rod, the gear thus disengaging a lock mechanism, the lock mechanism remaining fixed during setting; and re-engaging the gear with the lock mechanism.

* * * * *